US007204769B2

(12) United States Patent
Bandimere et al.

(10) Patent No.: US 7,204,769 B2
(45) Date of Patent: Apr. 17, 2007

(54) BALL HITTING PRACTICE DEVICE

(75) Inventors: John K. Bandimere, Carlsbad, CA (US); Randall S. Koch, San Diego, CA (US)

(73) Assignee: Pro Performance Sports, LLC, San Diego, CA (US)

( * ) Notice: Subject to any disclaimer, the term of this patent is extended or adjusted under 35 U.S.C. 154(b) by 0 days.

(21) Appl. No.: 11/126,857

(22) Filed: May 10, 2005

(65) Prior Publication Data

US 2006/0258485 A1 Nov. 16, 2006

(51) Int. Cl.
*A63B 69/00* (2006.01)
*A63B 69/36* (2006.01)

(52) U.S. Cl. ..... 473/417; 473/422

(58) Field of Classification Search ..... 473/417, 473/419, 420, 422, 423, 431, 451; 273/317.7, 273/317.8

See application file for complete search history.

(56) References Cited

U.S. PATENT DOCUMENTS

| | | | | |
|---|---|---|---|---|
| 63,517 | A | 4/1867 | Heermance | |
| 2,616,692 | A | 11/1952 | Bird | |
| 2,862,712 | A * | 12/1958 | Delia et al. | 473/423 |
| 3,176,986 | A | 4/1965 | Postasky | |
| 3,716,234 | A * | 2/1973 | Lancellotti | 473/481 |
| 3,874,662 | A * | 4/1975 | Harrington | 473/417 |
| 4,139,193 | A | 2/1979 | Felber et al. | |
| 4,364,563 | A * | 12/1982 | Stafford | 473/417 |
| 4,508,340 | A | 4/1985 | Liao | |
| 4,681,318 | A | 7/1987 | Lay | |
| 4,830,371 | A * | 5/1989 | Lay | 473/423 |
| 6,398,671 | B1 * | 6/2002 | Rios | 473/417 |
| 6,413,175 | B1 * | 7/2002 | Mooney, Jr. | 473/417 |
| 6,551,204 | B1 | 4/2003 | Di Re | |
| 6,616,554 | B2 | 9/2003 | Liao | |
| 6,778,915 | B2 | 8/2004 | Kelly et al. | |
| 6,916,256 | B1 * | 7/2005 | Buster et al. | 473/451 |
| 2005/0288120 | A1 * | 12/2005 | Brescia | 473/266 |
| 2006/0035729 | A1 * | 2/2006 | Wang | 473/417 |

* cited by examiner

*Primary Examiner*—Mitra Aryanpour
(74) *Attorney, Agent, or Firm*—Gordon & Rees LLP

(57) ABSTRACT

A ball hitting practice device has a base member, a post projecting upwardly from the base member and a pivot joint between the lower end of the post and the base member for allowing pivoting of the post in any direction about the base member to any selected tilt angle. A locking device is provided for securing the post at a selected angle and direction relative to the base member, and a cup is pivotally secured to the upper end of the post for supporting a ball. The cup can be pivoted relative to the post so as to face upwardly regardless of the tilt angle of the post relative to the base member.

19 Claims, 5 Drawing Sheets

BALL HITTING PRACTICE DEVICE

BACKGROUND OF THE INVENTION

The present invention relates generally to ball hitting practice devices which hold a ball so that it can be hit with a hitting implement, and is particularly concerned with such a device for use in baseball or softball hitting practice.

Baseball and softball practice hitting devices are generally known as batting tees, and normally have a flat base, a vertical post projecting upwardly from the base, and a ball placed on top of the post for hitting by a player. The base is typically of the same size and shape as a baseball home plate. The ball may be tethered to the device for easy retrieval. The post is generally adjustable in height.

One problem with most prior batting tees is that they can support the ball in one position above the tee only. This does not allow the batter to practice for real world situations, where the ball will arrive at different locations over home plate. Some prior art batting tees do allow for some adjustment in ball position relative to the base, but these are all subject to some disadvantages. U.S. Pat. No. 6,616,554 of Liao describes a training device in which the lower end of the post is pivotally attached to the base, and the post has a bendable portion which can be adjusted to keep the ball receiving cup upright. U.S. Pat. No. 2,616,692 of Bird describes an adjustable batting tee having a plurality of pivoted sections which would be quite difficult to adjust. U.S. Pat. No. 4,681,318 of Lay describes a ball hitting practice device for baseball and softball in which the post has a spring at its lower end which is pivotally attached to the base. The pivot mounting is used to adjust the inclination of the post, while the spring is simply used to allow the pedestal or post to bend when the ball is hit.

SUMMARY OF THE INVENTION

It is an object of the present invention to provide a new and improved ball hitting practice device or batting tee.

According to one aspect of the present invention, a ball hitting practice device is provided, which comprises a base member, a post projecting upwardly from the base member and having an upper end and a lower end, a pivot joint between the lower end of the post and the base member for allowing pivoting of the post in any direction about the base member, a locking device for securing the post at a selected angle and direction relative to the base member, and a cup pivotally secured to the upper end of the post for supporting a ball, whereby the cup can be pivoted relative to the post so as to face upwardly regardless of the pivot angle of the post relative to the base member.

In an exemplary embodiment of the invention, the pivot joint is a friction ball joint having a first part of at least partially spherical ball shape and a second part of cup shape for pivotally receiving the first part, one part of the joint being secured to the lower end of the post and the other part being secured to the base member. The locking device may comprise a locking screw projecting through aligned openings in the two parts, the other part having a threaded bore for receiving the locking screw, and the post is secured in a selected orientation by tightening the locking screw. In an exemplary embodiment of the invention, tightening of the locking screw is achieved simply by rotating the post. This makes it very easy for a user to adjust the post orientation and then lock the post in the desired orientation, and also makes it easy to re-adjust the post to a new orientation to practice hitting the ball over a different part of the base.

The base member may comprise a flat plate of any suitable material such as hard plastic or rubber, and may have the shape and dimensions of a baseball or softball home plate. Stabilizer rods may be provided for supporting the device in the upright condition and resisting tipping of the device when the ball is hit. The stabilizer rods may be releasably mounted at one end in bores or holes provided along a front edge of the base plate, and project outwardly from the base plate for added stability. In an exemplary embodiment, the rods are each provided with a bent end comprising a stake for pushing into the ground or turf so as to hold the device in position. The same bent ends can be inserted in the mounting holes in the base plate with the longer portions of the rods lying against the straight edge of the plate for storage when the device is not in use.

The cup may have spaced scallops or crenellations in its upper edge forming fingers for helping to hold the ball in position, or may have a brush along its upper edge for the same purpose. The post may comprise telescopically engaged upper and lower portions for height adjustment. An upper portion of the post adjacent the cup may be flexible, for example a bellows portion, so that it can bend on impact with a bat and prevent premature breakage. This will also allow the ball to release from the cup more easily.

In this invention, the pivoting or ball joint at the lower end of the post allows the post to be adjusted to any desired angle and in any direction, so that the ball receiving cup can be positioned at any desired point above the base member which represents home plate. At the same time, the post can be readily locked in its adjusted position, and the cup can be pivoted so that it faces upwardly regardless of the angle of the post. This allows the player to practice hitting balls at various different home plate positions and heights, mimicking different directions of approach of a pitch.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
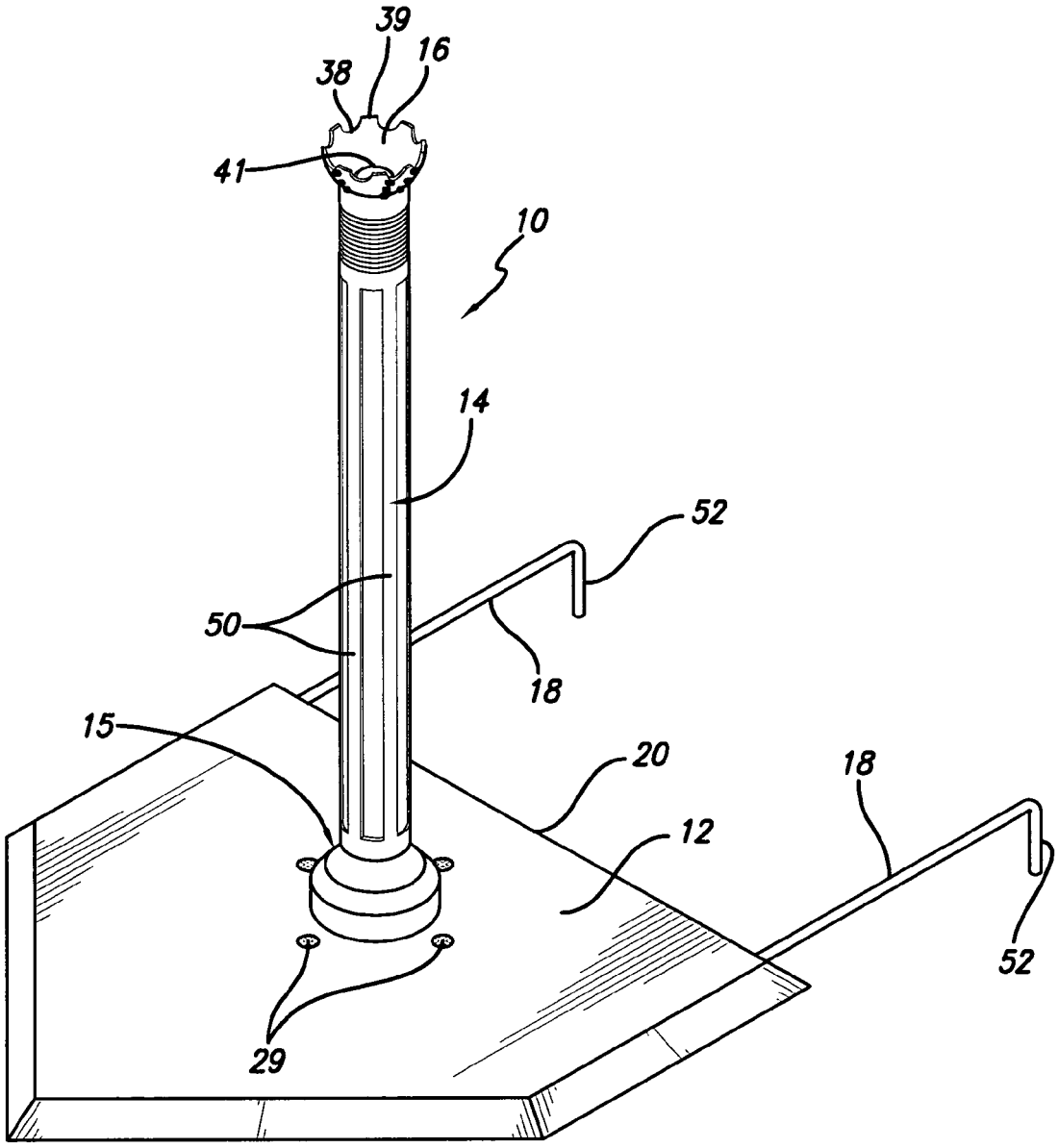
FIG. 1 is a perspective view of a ball hitting practice device according to an exemplary embodiment of the invention.

FIGS. 1 to 6 of the drawings illustrate a ball hitting practice device or batting tee 10 according to an exemplary embodiment of the invention for use in baseball or softball hitting practice. The device 10 basically comprises a base member 12 in the form of a flat panel or plate of suitable material such as rubber or plastic, a post 14 projecting upwardly from the base member and having a lower end pivotally secured to the base member by a friction ball joint 15, and a cup 16 for supporting a ball pivotally secured to the upper end of the post. A pair of stabilizer rods 18 project forwardly from opposite ends of the straight front edge 20 of the base member or plate 12.

Figure 2:
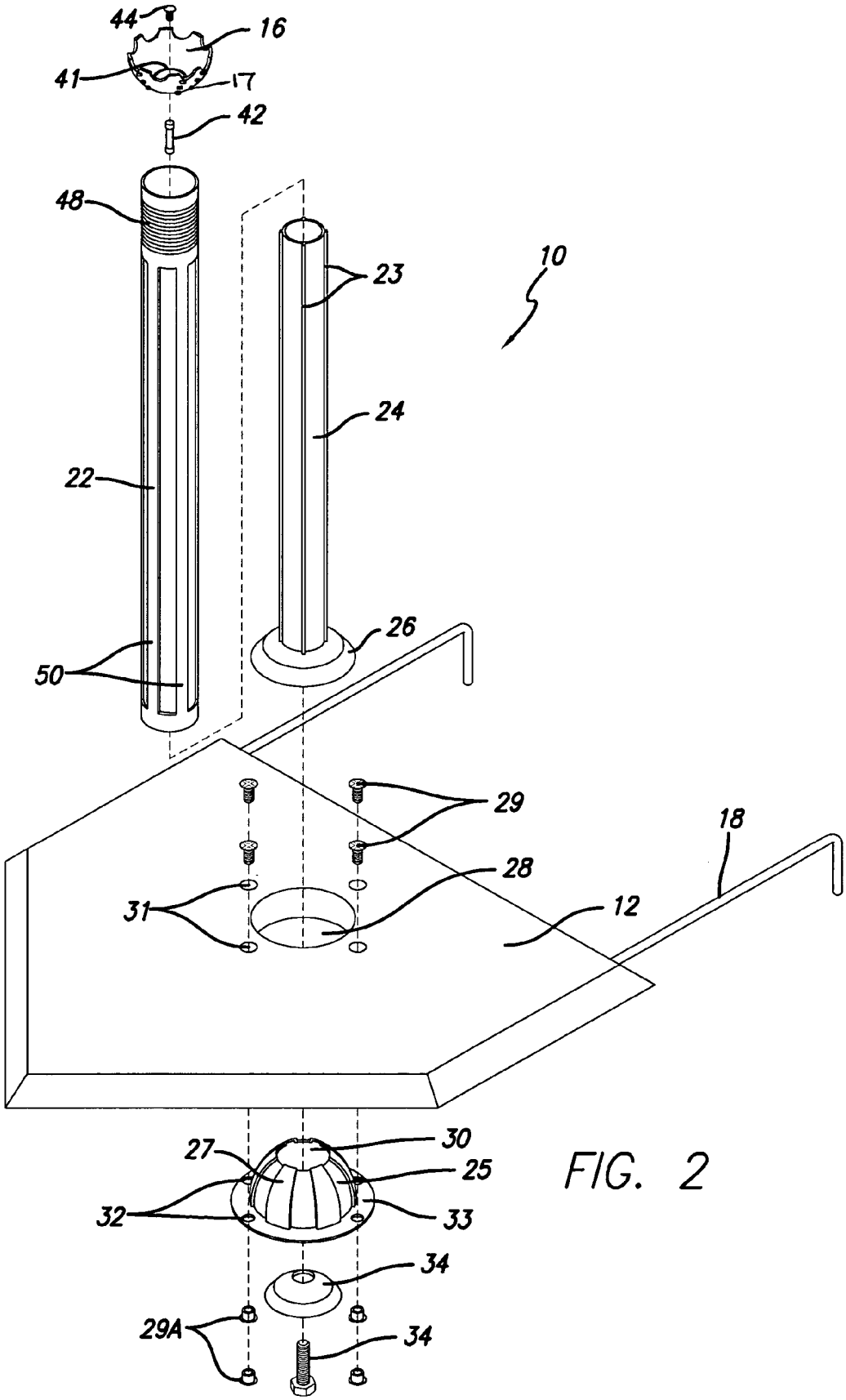
FIG. 2 is a view similar to FIG. 1 showing the components of the device separated from one another.
Figure 3:
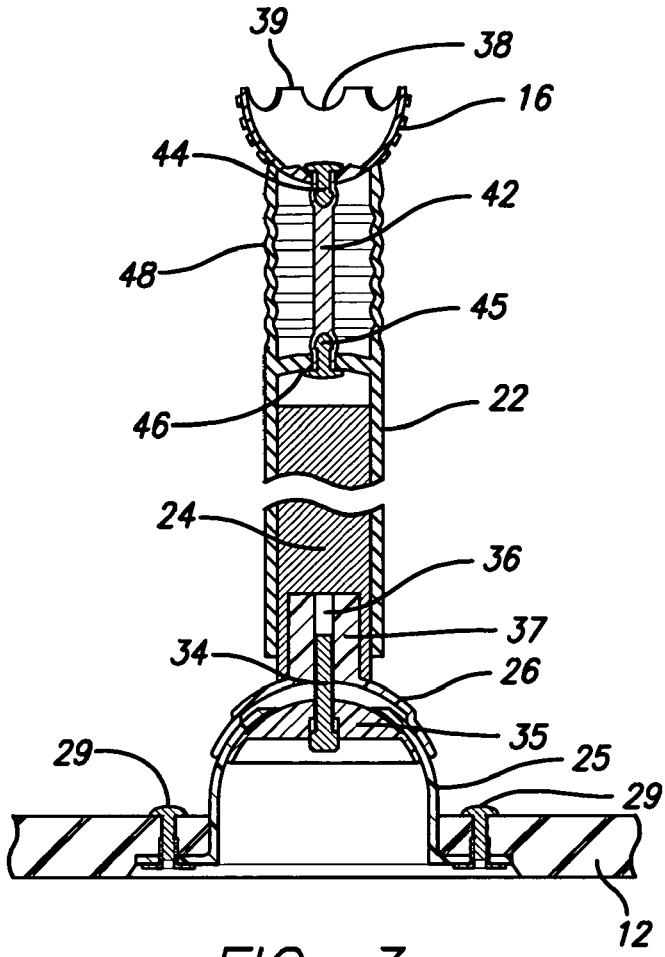
FIG. 3 is a partial vertical cross-section through the post and cup showing the pivotal attachment of the lower end of the post to the base member of the device of FIGS. 1 and 2, as well as the pivotal attachment of the cup to the upper end of the post.

FIGS. 2 and 3 illustrate the attachment of the post to the base plate and the cup to the post in more detail. The post 14 is formed in two telescoping parts, specifically an upper part 22 and a lower part 24 which is telescopically engaged inside the lower end of the upper part. The lower or inner part 24 of the post is a friction fit inside the upper part so that the overall height of the post can be readily adjusted. The inner part 24 may have external ribs 23 or other formations for frictional engagement in the outer part 22.

Figure 4:
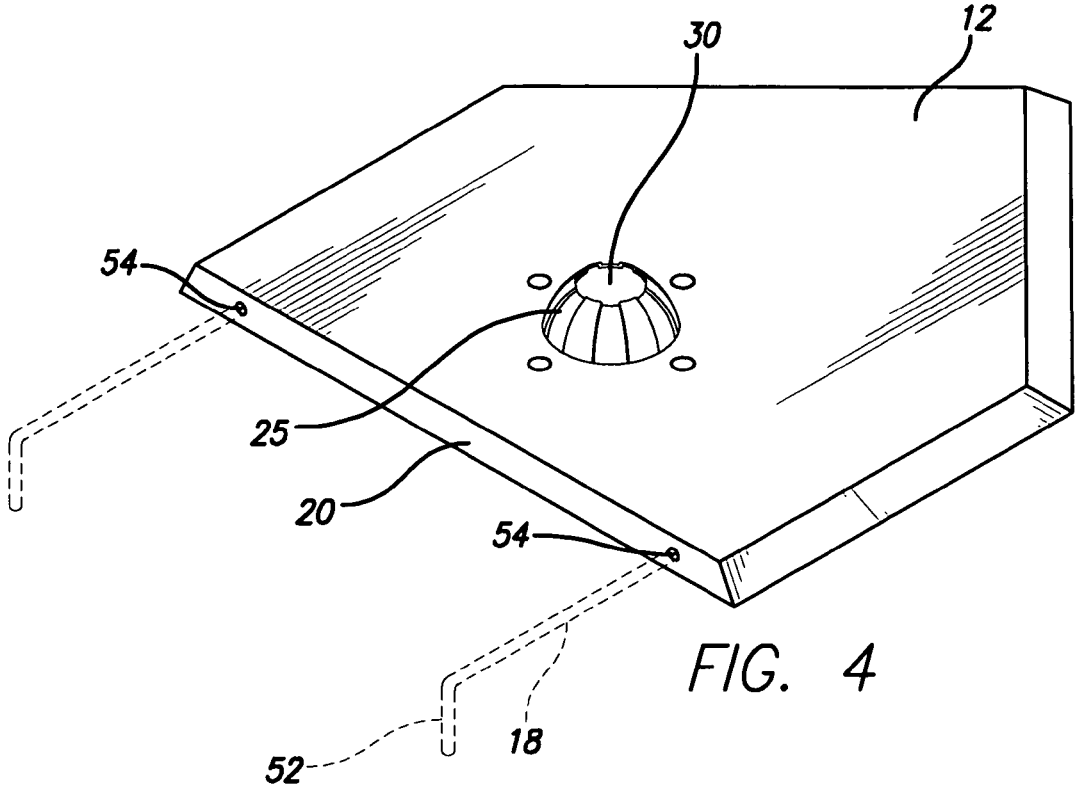
FIG. 4 is a perspective view of the base plate of the device of FIGS. 1 to 3 with the stabilizer rods shown in dotted outline.
Figure 5:
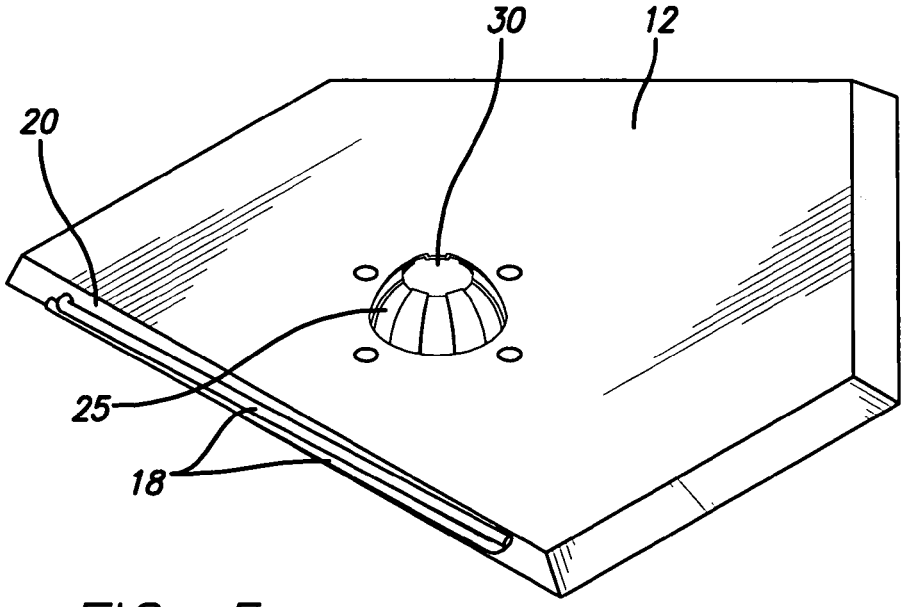
FIG. 5 is a perspective view similar to FIG. 4 illustrating the stabilizer rods in a storage position.

The ball joint 15 comprises a part-spherical, hollow convex ball seat 25 secured to the base and a part-spherical concave cup 26 secured to the lower end of post 14 for mating pivotal engagement with the seat, as best illustrated in FIG. 3. The seat is secured in an opening 28 in the base plate 12 so that the seat projects upwardly from the plate 12 when installed, as best illustrated in FIGS. 3 to 5. The seat 25 is secured in opening 28 via fastener bolts 29 which extend through aligned openings 31, 32 in the plate 12 and peripheral rim 33 of seat 25. Bolts 29 are secured by nuts 29A.

The seat 25 has a central opening 30. Seat 25 has shaped outer ribs 27 to absorb impact and keep the tightened joint from loosening. A fastener or locking screw 34 extends through a part spherical head or lock nut 35 engaging on the inner face of the seat 25, through the opening 30, and into a threaded bore 36 in the stem 37 of cup 26. The screw is tightened or loosened by rotation of the post 14 in opposite directions, which will act to thread the screw 34 into or out of bore 36. The screw can be loosened to allow the post to be pivoted about the seat 25 to a desired orientation, and can be tightened to press the seat 25 firmly against the cup 26 to resist pivoting motion and to lock the post in a selected position. The two parts of the ball joint may be made of plastic or rubber material.

Figure 3A:
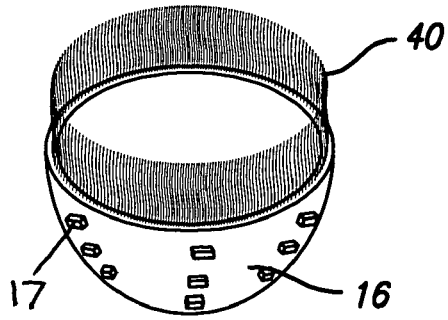
FIG. 3*a* is a side view of a modified cup with a brush-like element.

The ball holding cup 16 at the upper end of the post has an upper edge which is crenellated with a series of rounded indentations or scallops 38 forming raised fingers 39 between the indentations. This allows a ball seated in the cup to be released readily when hit, while the fingers will tend to hold the ball in position until impact with a bat. Instead of the crenellated upper edge, the cup 16 may have a brush-like element 40 secured around its upper edge, as illustrated in FIG. 3A, in order to retain the ball.

The cup has a central opening 41 (see FIGS. 2 and 3) and is held on the open upper end of the upper part 22 of the post by a resilient tether or cord 42 having a first end secured to the cup by a nipple or cap 44 extending through opening 41. The second end of tether 42 is secured in the post by a second nipple or cap 45 extending through an opening in a transverse wall 46 in the hollow upper part 22 of the post. Transverse wall 46 is cone shaped to absorb impact if bat strikes too low and reduce the risk of the post cracking. The tether 42 may be a short length of rubber tubing or the like. The dimensions of tether 42 are such that the cup 16 will be firmly seated against the upper end of the post 14, but can be pulled up and re-positioned at a different angle relative to the post as required, as will be explained in more detail below. On the exterior of the cup are ridges/protrusions 17 that hold the cup in place when placed at an angle.

The upper part 22 of the post 14 is a hollow tubular member which has a flexible bellows portion 48 at its upper end between transverse wall 46 and the upper end of the post. It also has external, longitudinally extending ribs 50 which will allow the user to grip the post more easily in order to rotate the post and pivot cup 26 relative to the seat 25, thereby tightening or loosening the head and cup of the ball joint to allow adjustment of the post. It will be understood that the two parts 22, 24 of the post 14 will have suitable mating formations which allow relative axial or telescoping movement between these parts but prevent relative rotation, such as mating vertical ribs and grooves as illustrated in FIG. 2.

Each stabilizer rod 18 is a straight metal rod having a bent end 52 forming a stake for pushing into the ground when the device is deployed on a surface such as turf, grass or the like. The opposite end of the rod is inserted into a respective opening or bore 54 in the end face 20 of the base plate (see FIG. 4). FIGS. 1 and 2 illustrate the stabilizer rods 18 deployed and ready for use. FIG. 5 illustrates a storage position for the rods when the device is not in use. The rods 18 are simply pulled out of openings 54 and reversed so that the bent ends 52 engage in the openings and the remainder of each rod lies across the front face 20 of the base plate. This avoids the risk of the stabilizer rods becoming separated from the practice device and lost. If necessary, weights could be added to the plate when deployed to further reduce the risk of tipping when a ball is hit.

Figure 6:
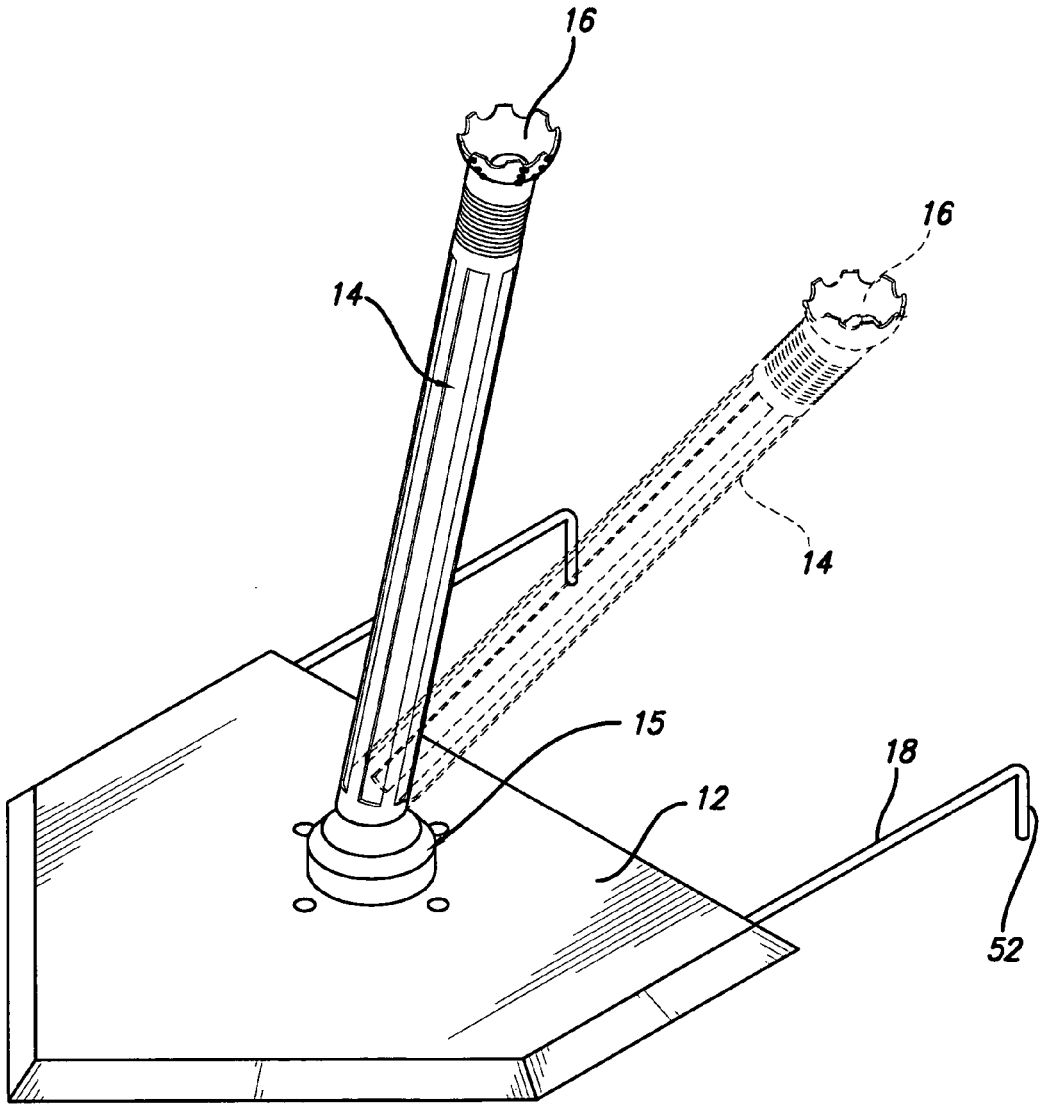
FIG. 6 is a perspective view of the device similar to FIG. 1 but illustrating the post and cup in an adjusted, tilted position.

When the hitting practice device 10 is deployed as in FIG. 1, the hitter can either practice with the post in a vertically upright position as in this figure, or can rotate the post 14 so as to loosen the ball joint 15. They can then tilt the post 14 forwardly, rearwardly, sideways, or in any intermediate direction, with the joint cup 26 pivoting about the seat 25 to accommodate the tilting of the post. Once the post is adjusted to the desired position, based on the desired height and location of the ball to be hit relative to the base plate 12, the post 14 is simply rotated back in the opposite direction so as to lock the post in the adjusted position. FIG. 6 illustrates two possible tilted positions of post 14 by way of example, with one of the positions shown in dotted outline. Once the post has been tilted and locked in position, the ball receiving cup 16 must also be adjusted. This is done by pulling the cup up and away from its seat at the upper open end of post 14, simultaneously stretching the tether or tubing 42. The cup 16 is then pivoted into an upright or upwardly facing orientation, and then placed back against the upper end of the post 14, as indicated in FIG. 6. The tether will hold the cup in the new position until it is re-positioned by the user. This allows the cup to hold a ball even when the post is pivoted to an extreme angle, as indicated in dotted outline in FIG. 6.

When the post and cup have been appropriately adjusted, a ball can be placed in cup 16, and the batter can hit the ball. The fingers at the top of cup 16 and the pivoting of the cup will enable the ball to be released more easily on impact, while the resilient bellows portion 48 will also bend on impact to reduce the risk of damage to the post. After hitting has been practiced several times in one position, the post and cup can be adjusted to a new position for practice in hitting a ball arriving at a different position over the plate.

The ball may be completely separate from the practice device 10, such that balls have to be retrieved after hitting, or it may be attached to the cup by a suitable elastic tether, as in some prior art batting tees. The base plate may be a standard seventeen inch plate or smaller/larger if desired. The stabilizer rods allow the base plate to be anchored and will resist tipping of the device on impact. At the same time, the rods can be readily moved to a storage position when the device is not in use.

The batting practice device of this invention is extremely versatile and allows a ball to be positioned quickly and easily at any desired height and at any desired location relative to the base plate. It can therefore mimic any likely ball striking or ball arrival position at the plate, not just a location directly over the center of the plate. The ball holding cup is designed to hold the ball securely prior to impact, yet readily releases the ball on impact, due to the scalloped upper edge or brush and the pivotal mounting of the cup. The cup can be readily adjusted to face upwardly regardless of the angle of the post. The flexible upper end portion of the post will bend on impact to reduce the risk of damage or breakage of the post after repeated hits by a bat, increasing the lifetime of the device.

Although an exemplary embodiment of the invention has been described above by way of example only, it will be understood by those skilled in the field that modifications may be made to the disclosed embodiment without departing from the scope of the invention, which is defined by the appended claims.

We claim:

1. A ball hitting practice device, comprising:

a base member;

a post projecting upwardly from the base member and having an upper end and a lower end;

a friction ball joint between the lower end of the post and the base member for allowing pivoting of the post in any direction about the base member to a selected tilt angle, which comprises a cup-shaped part secured to the lower end of the post and a hollow seat of at least partially spherical ball shape secured to the base for pivotally receiving the cup-shaped part;

a locking device for securing the post at the selected tilt angle and direction relative to the base member; and a cup pivotally secured to the upper end of the post for supporting a ball, whereby the cup can be pivoted relative to the post so as to face upwardly regardless of the pivot angle of the post relative to the base member.

2. The device as claimed in claim 1, wherein the hollow seat of the pivot joint has a central opening and an inner surface, and the cup-shaped part has an upwardly extending stem secured to the lower end of the post, the cup-shaped part having a threaded bore extending into the stem and aligned with the opening in the hollow seat, and the locking device comprises a partially spherical head engaging on the inner surface of the hollow seat and a locking screw projecting through the opening in the hollow seat and threadably engaged in the bore in the stem, whereby the post is secured in a selected orientation by tightening the locking screw in the bore.

3. The device as claimed in claim 1, wherein the locking device is tightened or loosened by rotating the post in opposite directions.

4. The device as claimed in claim 1, wherein the post has outer gripping formations for gripping by a user when rotating the post.

5. The device as claimed in claim 1, wherein the base member comprises a flat plate and having a straight forward edge.

6. The device as claimed in claim 5, including at least two stabilizer rods projecting forwardly from the forward edge of the plate in a deployed position of the rods.

7. The device as claimed in claim 6, wherein each rod has a bent forward end comprising a stake for embedding in the ground to secure the plate in a selected position.

8. The device as claimed in claim 7, wherein the forward edge of the plate has mounting bores for receiving the rear ends of the respective stabilizer rods in the deployed position, the stabilizer rods being releasably mounted in the bores.

9. The device as claimed in claim 8, wherein the mounting bores further comprise means for receiving the bent ends of the stabilizer rods in a storage position, the rods extending across the forward edge of the base plate in the storage position.

10. The device as claimed in claim 1, wherein the cup has an upper edge having series of spaced scallops forming upwardly projecting fingers between the scallops for retaining a ball in the cup prior to impact.

11. The device as claimed in claim 1, wherein the cup has an upper edge and a brush member is secured around the upper edge of the cup.

12. The device as claimed in claim 1, further comprising a resilient tether securing the cup to the upper end of the post at a selected orientation relative to the post, the upper end of the post comprising a pivot seat for the cup.

13. The device as claimed in claim 1, wherein the post comprises telescopically engaged upper and lower portions for height adjustment.

14. The device as claimed in claim 1, wherein the post has an upper portion adjacent the cup which is flexible.

15. The device as claimed in claim 14, wherein the flexible upper portion comprises a bellows portion.

16. The device as claimed in claim 1 wherein the cup has external protrusions for holding the cup in any selected pivoted positions of the cup relative to the post.

17. The device as claimed in claim 1, wherein the hollow seat of the friction ball joint has a central opening and an inner surface, and the cup-shaped part has an upwardly extending stem with a threaded bore aligned with the opening in the hollow seat, the stem being secured to the lower end of the post.

18. The device as claimed in claim 17, wherein the locking device comprises a partially spherical head engaging on the inner surface of the hollow seat and a locking screw projecting through the opening in the hollow seat and threadably engaged in the bore in the stem, whereby the post is secured in a selected orientation by tightening the locking screw in the bore in the stem of the cup-shaped part.

19. The device as claimed in claim 1, wherein the hollow seat of the pivot joint has outer ribs for absorbing impact and keeping the tightened pivot joint from loosening.

* * * * *